US010699587B2

(12) United States Patent
Hvezda et al.

(10) Patent No.: US 10,699,587 B2
(45) Date of Patent: Jun. 30, 2020

(54) AIRCRAFT TAXIWAY ROUTING

(71) Applicant: Honeywell International Inc., Morris Plains, NJ (US)

(72) Inventors: Jakub Hvezda, Knezeves (CZ); Karel Macek, Prague (CZ); Karel Marik, Revnice (CZ)

(73) Assignee: Honeywell International Inc., Morris Plains, NJ (US)

( * ) Notice: Subject to any disclaimer, the term of this patent is extended or adjusted under 35 U.S.C. 154(b) by 183 days.

(21) Appl. No.: 15/633,393

(22) Filed: Jun. 26, 2017

(65) Prior Publication Data

US 2018/0374370 A1 Dec. 27, 2018

(51) Int. Cl.
*G08G 5/06* (2006.01)
*G08G 5/00* (2006.01)

(52) U.S. Cl.
CPC ..... *G08G 5/065* (2013.01); *G08G 5/0013* (2013.01); *G08G 5/0043* (2013.01); *G08G 5/0082* (2013.01); *G08G 5/06* (2013.01)

(58) Field of Classification Search
CPC .... G08G 5/065; G08G 5/0021; G08G 5/0013; G08G 5/045; G08G 5/06; G08G 5/0008; G08G 5/0017
See application file for complete search history.

(56) References Cited

U.S. PATENT DOCUMENTS

2004/0006412 A1* 1/2004 Doose ..... G01C 21/26 701/10
2009/0150013 A1* 6/2009 Finn ..... G08G 5/0026 701/11
2010/0092045 A1* 4/2010 Zimmer ..... G06F 16/29 382/113
2011/0231096 A1* 9/2011 Ridenour, II ..... G08G 5/0008 701/301
2013/0103297 A1* 4/2013 Bilek ..... G08G 5/0021 701/120
2014/0303815 A1* 10/2014 Lafon ..... G01C 21/3446 701/3
2016/0140849 A1* 5/2016 Ball ..... G08G 5/0021 701/538
2016/0189551 A1* 6/2016 Pereira ..... G01C 21/00 701/532
2016/0260335 A1* 9/2016 Chenna ..... G08G 5/0013
2018/0374370 A1* 12/2018 Hvezda ..... G08G 5/065

* cited by examiner

*Primary Examiner* — Redhwan K Mawari
(74) *Attorney, Agent, or Firm* — Brooks, Cameron & Huebsch, PLLC

(57) ABSTRACT

Methods, devices, and systems for aircraft taxiway routing are described herein. One device includes a memory, and a processor to execute executable instructions stored in the memory to receive routing data associated with an airfield of an airport, determine a group of taxiway routes associated with the airfield of the airport using the routing data where each respective taxiway route includes a number of taxiway segments, receive a routing plan request, generate a routing plan for an aircraft at the airfield using the group of taxiway routes in response to receiving the routing plan request, and a user interface to display the routing plan in a single integrated display.

18 Claims, 4 Drawing Sheets

AIRCRAFT TAXIWAY ROUTING

TECHNICAL FIELD

The present disclosure relates to methods, devices, and systems for aircraft taxiway routing.

BACKGROUND

Air traffic control (ATC) at an airport can direct aircraft on an airfield of the airport and aircraft in airspace near the airport, as well as provide advisory services to other aircraft in airspace not controlled by ATC at the airport. Directing aircraft on the airfield and in the air can prevent collisions between aircraft, organize and expedite aircraft traffic, and provide information and/or support for aircraft pilots.

Pilots of aircraft at an airfield can receive instructions from ATC while at the airport. For example, an inbound aircraft can receive instructions from ATC on where to land, where to park the aircraft, a routing plan to taxi from the runway to a parking stand, etc.

Pilots of taxiing aircraft can be subject to the instructions from ATC while at the airport. For example, ATC may instruct a pilot of an aircraft to hold the aircraft at a hold point on the airfield in order for other aircraft or other traffic to pass. As a result of other airport traffic, ATC may instruct aircraft to take longer taxiway routes to accommodate the airport traffic.

DETAILED DESCRIPTION

Figure 1:
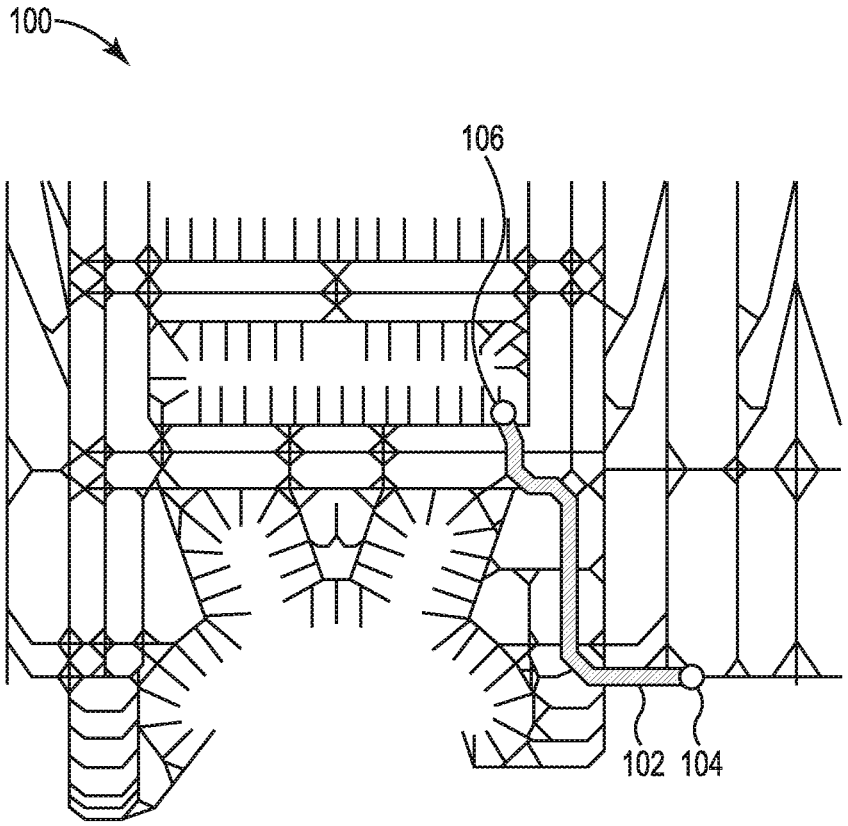
FIG. 1 is an illustration of a display provided on a user interface showing an airfield, generated in accordance with one or more embodiments of the present disclosure.

Methods, devices, and systems for aircraft taxiway routing are described herein. In some examples, one or more embodiments include a memory, and a processor to execute executable instructions stored in the memory to receive routing data associated with an airfield of an airport, determine a group of taxiway routes associated with the airfield of the airport using the routing data where each respective taxiway route includes a number of taxiway segments, receive a routing plan request, generate a routing plan for an aircraft at the airfield using the group of taxiway routes in response to receiving the routing plan request, and a user interface to display the routing plan in a single integrated display.

Aircraft taxiway routing, in accordance with the present disclosure, can provide a routing plan for an aircraft at an airfield. The routing plan can be a route from one location on an airfield to a different location on the airfield. For example, a routing plan can be utilized by an aircraft to navigate from a runway to a parking stand. The routing plan can be generated utilizing data capturing past taxiway routing plans and global routing conditions associated with past taxiway routing plans. Aircraft taxiway routing can be adaptable to different airport systems and layouts, and can provide for safe and efficient taxiway route planning, which may reduce delays for passengers and/or airlines.

Aircraft taxiway routing can be displayed on a single integrated display. Presenting the aircraft taxiway routing in a single integrated display can allow a user or others to quickly assess generated taxiway routing plans, modify the taxiway routing plans if necessary, and communicate taxi instructions to a pilot to execute the taxiway routing plan. A user, as used herein, may include an ATC controller, an ATC controller supervisor, a system engineer administrator, a system engineer, and/or a duty engineer, among other users.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 302 in FIG. 3.

FIG. 1 is an illustration of a display provided on a user interface showing an airfield 100, generated in accordance with one or more embodiments of the present disclosure. As illustrated in FIG. 1, the airfield 102 can include a routing plan 102, a start point 104, and an end point 106.

As used herein, a routing plan can, for example, refer to a taxiway route of a vehicle from a first location to a second location on an airfield. For example, as shown in FIG. 1, routing plan 102 can indicate a taxiway route for a vehicle on airfield 100 to allow the vehicle to travel from the start point 104 to the end point 106. As used herein, a vehicle can refer to an aircraft, an aircraft support vehicle (e.g., a tug, stair car, food truck, etc.), and/or a maintenance vehicle, among other vehicles located on an airfield.

Start point 104 can be a starting point of routing plan 102. For example, in the case of an aircraft that is inbound to the airport, start point 104 can be a runway. That is, an aircraft that has landed at airfield 100 can have a routing plan for a taxiway route from the runway the aircraft has landed on.

End point 106 can be an ending point of routing plan 102. Continuing with the example above, the routing plan for the taxiway route can have a start point 104 at the runway the aircraft has landed on, and end point 106 can be a parking stand. For instance, routing plan 102 for an inbound aircraft can have a start point 104 as the runway, and an end point 106 as a parking stand.

Although start point 104 and end point 106 are described above as being a runway and a parking stand, respectively, embodiments of the present disclosure are not so limited.

For example, in the case of an outbound aircraft, start point 104 may be a parking stand and end point 106 may be a runway, among other start and end points of an airfield.

Routing plan 102 can be generated by a computing device (e.g., computing device 416, described in connection with FIG. 4). The computing device can receive routing data associated with airfield 100 of an airport.

Routing data can include historical routing plans for aircraft at airfield 100. For example, a historical routing plan can include a start point, an end point, and a sequence of taxiway segments the aircraft utilized to move from the start point to the end point. Each historical routing plan can include routing data corresponding to each historical routing plan, as is further described herein.

Routing data can include positions of vehicles and/or positions of different aircraft on airfield 100 of the airport. For example, routing data can include locations of other vehicles and/or aircraft relative to the aircraft the routing plan 102 is generated for.

Routing data can include an occupancy of taxiway segments of each respective taxiway route included in a group of taxiway routes. As used herein, a group of taxiway routes can include possible taxiway routes an aircraft could take to travel from start point 104 to end point 106. Each taxiway route can include a number of taxiway segments, as is further described in connection with FIG. 2. Taxiway segments can be occupied by other vehicles or aircraft on airfield 100. Routing data can include an occupancy status (e.g., whether the taxiway segment is occupied or unoccupied) of each taxiway segment making up each taxiway route included in the group of taxiway routes. For example, a taxiway segment may have a different aircraft taxiing on the taxiway segment; the occupancy status of that taxiway segment may accordingly be deemed as occupied.

Routing data can include global routing conditions. Global routing conditions can include global conditions of airfield 100 of the airport. For example, global routing conditions can include weather conditions at the airport, time of day, aircraft movement type (e.g., inbound or outbound, etc.), and/or aircraft class (e.g., super heavy aircraft, heavy aircraft, medium aircraft, and/or small aircraft, etc.), among other global routing conditions.

Figure 2:
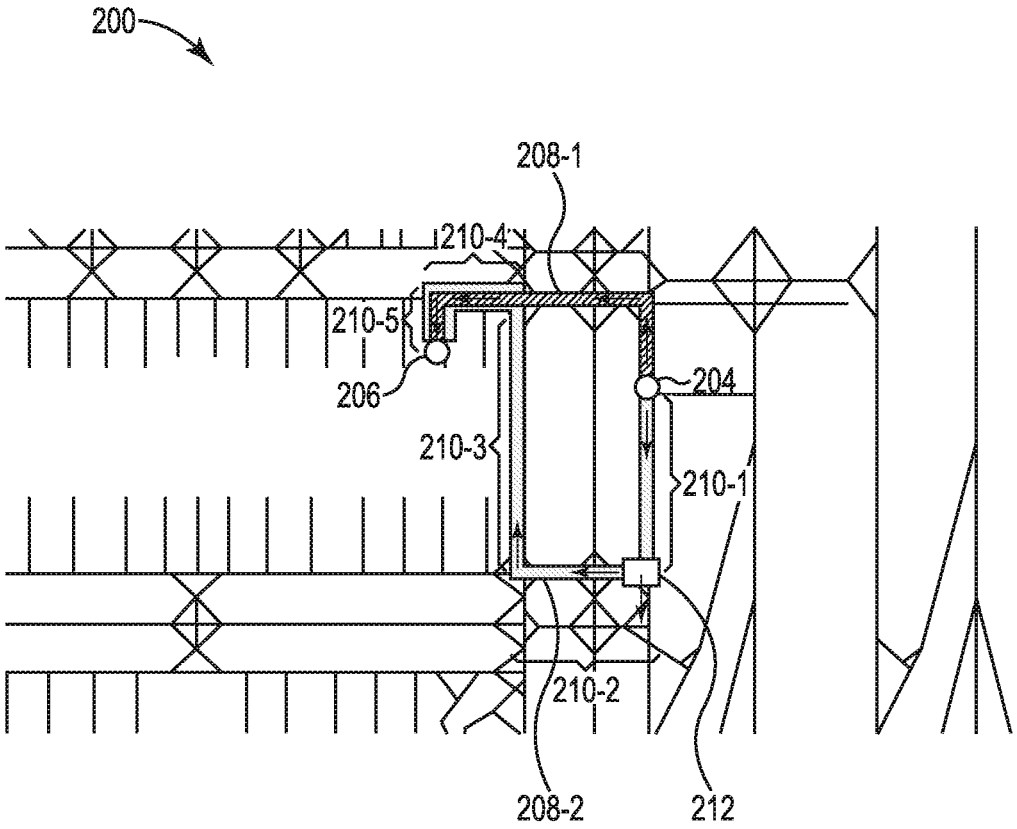
FIG. 2 is an illustration of a display provided on a user interface showing an airfield, generated in accordance with one or more embodiments of the present disclosure.

FIG. 2 is an illustration of a display provided on a user interface showing airfield 200, generated in accordance with one or more embodiments of the present disclosure. As illustrated in FIG. 2, airfield 200 can include start point 204, end point 206, taxiway route 208-1, 208-2, and taxiway segment junction 212. Taxiway route 208-2 can include taxiway segment 210-1, 210-2, 210-3, 210-4, 210-5.

A computing device (e.g., computing device 416, described in connection with FIG. 4) can determine a group of taxiway routes 208-1, 208-2 associated with airfield 200 of the airport using routing data. The group of taxiway routes 208-1, 208-2 can be determined for a start point 204 on the airfield 200 and an end point 206 on the airfield 200. For example, as illustrated in FIG. 2, the computing device can generate two taxiway routes (e.g., 208-1 and 208-2). That is, an aircraft located at start point 204 can take two possible taxiway routes: taxiway route 208-1, or taxiway routes 208-2.

Although described above as determining two taxiway routes associated with the group of taxiway routes, embodiments of the present disclosure are not so limited. For example, the computing device can generate more than two taxiway routes that make up the group of taxiway routes or less than two taxiway routes that make up the group of taxiway routes.

Each taxiway route 208-1, 208-2 can include a number of taxiway segments. The number of taxiway segments in each taxiway route can be a sequence of taxiway segments. For example, as illustrated in FIG. 2, taxiway route 208-2 can include a sequence of taxiway segments 210-1, 210-2, 210-3, 210-4, and 210-5. That is, an aircraft at start point 204 can utilize the sequence of taxiway segments 210-1, 210-2, 210-3, 210-4, and 210-5 to travel from start point 204 to end point 206 via taxiway route 208-2.

Although taxiway route 208-2 is illustrated in FIG. 2 and described above as including five taxiway segments, embodiments of the present disclosure are not so limited. For example, a different taxiway route may include more than five taxiway segments or less than five taxiway segments.

The computing device can determine the group of taxiway routes 208-1, 208-2 using routing data by representing each taxiway segment of a sequence of taxiway segments included in each respective taxiway route of the group of taxiway routes as a single vector representation. That is, the computing device can determine the group of taxiway routes 208-1, 208-2 using a single vector representation of the taxiway segments of each respective taxiway route included in the group of taxiway routes 208-1, 208-2. The single vector representation can be utilized to determine all possible paths of each taxiway route from start point 204 to end point 206.

The computing device can determine the group of taxiway routes 208-1, 208-2 using a matrix representation of occupancy of the taxiway segments of each respective taxiway route included in the group of taxiway routes 208-1, 208-2 and discretized time intervals. The matrix representation can represent current and/or expected or predicted traffic on taxiway segments included in taxiway routes of the group of taxiway routes 208-1, 208-2. In other words, the matrix representation can represent occupancy of a sequence of taxiway segments included in each respective taxiway route of the group of taxiway routes 208-1, 208-2. A taxiway segment of a taxiway route included in the group of taxiway routes 208-1, 208-2 can be represented as occupied in the matrix representation in response to a different aircraft or other vehicle being present on the taxiway segment. For example, taxiway segment 210-2 can be represented as occupied in response to a different aircraft from the aircraft at start point 204 being present on taxiway segment 210-2.

For example, the layout of airfield 200 can be represented as a graph, G=(V, E), where V is a set of vertices (e.g., representing taxiway segment junctions, as is further described herein) and E is a set of edges. A taxiway route can be represented as r=(p, o) where the variable "p" is a path on the airfield layout and the variable "o" is an occupancy of the taxiway segments comprising the taxiway route. The path can be given as a sequence of consecutive edges from E.

By combining all taxiway routes, airfield occupancy can be defined as information when edges or vertices are occupied by an aircraft or other vehicle. For instance, a mapping can be introduced:

$$b: V \cup E \rightarrow \mathcal{J}(\mathbb{R}_4) \quad \text{(Eq. 1)}$$

where $\mathcal{J}(\mathbb{R}_+)=\{[a, b]; a, b \in \mathbb{R}_+: a<b\}$ of Equation 1 is a set of all intervals on $\mathbb{R}_+$. Specifically, b(r) indicates time intervals when a resource (e.g., a taxiway segment) is occupied. The time may be assumed to be relative to the current time instant. That is, the time is assumed to start at zero.

Given the layout of airfield 200, airfield occupancy, routing data (e.g., historical routing plans, positons of vehicles and different aircraft on the airfield 200, global routing conditions, etc.), start point 204, and end point 206, taxiway routes can be determined. Global routing conditions (e.g., weather conditions, time of day, aircraft movement type, aircraft class, etc.) can be represented by a variable "c", start point 204 can be represented by a variable "s", and end point 206 can be represented by a variable "e". Criteria such as shortest taxiway route (in terms of distance or in terms of total taxi time), or similarity with previous taxiway routing plans can be considered.

To generate taxiway routing plans with similarity to previous taxiway routing plans, historical routing plans for aircraft at airfield 200 can be considered. The historical routing plans can comprise input-output pairs. The input of the historical routing plans can be a combination of airfield occupancy, historical global routing conditions, and start and end point of the taxiway route to be calculated. The output of the historical routing plans can be a routing plan. The input-output pairs can be labeled as $(x_i, y_i)$ where $x_i=(c_i, b_i, s_i, e_i)$ and $y_i=(p_i, o_i)$.

The computing device can determine taxiway routes of the group of taxiway routes using the matrix representation by classification of the single vector representation at each taxiway segment junction of the taxiway segments between a start point and an end point of that taxiway route. For example, the computing device can determine a taxiway route by classification of the single vector representation at, for example, taxiway segment junction 212.

The computing device can determine a taxiway route by classification of the single vector representation as a sequence of decisions made at specific vertices (e.g., at specific taxiway segment junctions, such as taxiway segment junction 212). Thus, as illustrated in FIG. 2, taxiway route 208-2 can be determined by a sequence of four decisions made at various taxiway segment junctions.

The end vertex e can be a binary vector of dimension |V|, where all components are zero with the exception of the index that corresponds to e. The start vertex s is not encoded as it may be assumed that planning the taxiway route begins at the vertex that corresponds to a specific classification/decision making task. The variable c (e.g., global routing variables) can be coded as a binary vector.

Occupancy can be represented by the matrix representation. The matrix representation can include an index of a resource represented by variable "k", where a resource can be a location at which occupancy may be considered. For example, a resource in the matrix representation can include a taxiway segment, a gate, a runway, a taxiway segment junction, etc.

The matrix representation can include an index of a time interval represented by variable "t". The time interval can be discretized from the current time onwards so that m intervals exist. For example, the m intervals can be $[t_0, t_1)$, $[t_1, t_2)$, . . . $[t_{m-1}, t_m)$ where $t_0=0$ is the current time and $t_m$ is sufficiently large. The time interval can be one second, more than one second, or less than one second, and can be configurable.

The matrix representation can be represented by variable "B" and can be a binary matrix of shape n×m, where $n=|V \cup E|$ is the number of all resources. $B_{k,j}=1$ if resource k is occupied in at least a part of interval $[t_{j-1}, t_j)$. If $B_{k,j}=0$, then resource k is not occupied.

The computing device can determine a respective taxiway route of the group of taxiway routes using the matrix by classification of the single vector representation at each taxiway segment junction of the taxiway segments between a start point and an end point of that taxiway route. That is, the taxiway route can be considered as a sequence of decisions at taxiway segment junctions. Binary vectors can be used to encode those decisions. For each vertex, classification methods may be used such as deep-learning networks, support vector machine (SVM) classification, and/or other methods of classification may be utilized.

For example, the computing device can determine, at taxiway segment junction 212, the next taxiway segment for the taxiway route by classification. For instance, the next taxiway segment can be taxiway segment 210-2, or can be a taxiway segment continuing in the same direction relative to the start point 204 (e.g., as shown by arrows at taxiway segment junction 212).

The computing device can determine the taxiway route by generating a most likely path from start point 204 to end point 206 using the classification of the single vector representation at each taxiway segment junction of the taxiway segments of that taxiway route. For example, the computing device can generate the most likely path at taxiway segment junction 212, and each taxiway segment junction thereafter, as is described herein.

Given a local classifier at each vertex (e.g., at each taxiway segment junction), the likelihood of the path can be determined. The likelihood of the path can be represented as P(p|conditions)→max, which can be decomposed as follows:

$$\Pi_{v \in p} P(v_{next} | v, \text{conditions for } v) \rightarrow \max \quad \text{(Eq. 2)}$$

Equation 2 can be transformed to a shortest path problem as follows:

$$-\Sigma_{v \in p} \log(P(v_{next} | v, \text{conditions for } v)) \rightarrow \min \quad \text{(Eq. 3)}$$

Equation 3 can be solved by a Dijkstra algorithm. That is, Equation 3 can be solved by finding the shortest paths between nodes in a graph.

The computing device can determine a probability of each taxiway segment of the sequence of taxiway segments of each respective taxiway route of the group of taxiway routes. For example, using the methods described above, the computing device can determine a probability of taxiway segment 210-2, or a probability of a taxiway segment continuing in the same direction relative to the start point 204 (e.g., as shown by arrows at taxiway segment junction 212). For example, the computing device can determine an 80% probability to take taxiway segment 210-2, and a 20% probability to continue in the same direction relative to start point 204. That is, with respect to the orientation of FIG. 2, at taxiway segment junction 210-2, the computing device can determine an 80% probability to go left (e.g., taxiway segment 210-2) and a 20% probability to go down.

The computing device can determine the respective taxiway route of the group of taxiway routes by selecting the taxiway segment at the taxiway segment junction having a higher probability than other taxiway segments at the taxiway segment junction for each taxiway segment junction of that taxiway route. Continuing with the example above, the computing device can select taxiway segment 210-2 as the next taxiway segment at taxiway segment junction 212 over the taxiway segment continuing down relative to start point 204, as taxiway segment 210-2 has an 80% probability and the taxiway segment continuing down relative to start point 204 has a 20% probability.

Although the computing device is described above as selecting a taxiway segment at a taxiway segment junction having two taxiway segments, embodiments of the present disclosure are not so limited. For example, the computing device can select a taxiway segment having the highest probability of a taxiway segment junction with more than two taxiway segments.

In some embodiments, the computing device can select a taxiway segment at the taxiway segment junction having a lower likelihood cost than other taxiway segments at the taxiway segment junction in response to the probability for each taxiway segment at the taxiway segment junction being equal. For example, taxiway segment 210-2 can have a 50% probability and the taxiway segment continuing down relative to start point 204 can have a 50% probability. The computing device can choose the taxiway segment based on a probability beyond the taxiway segment junction. For example, taxiway segments beyond taxiway segment 210-2 can have a higher probability than taxiway segments beyond the taxiway segment continuing down relative to start point 204, and the computing device can choose taxiway segment 210-2.

Although described above as choosing taxiway segments based on a probability beyond the taxiway segment junction, embodiments of the present disclosure are not so limited. For example, taxiway segment 210-2 can have a 40% probability and the taxiway segment continuing down relative to start point 204 can have a 60% probability, but taxiway segments beyond taxiway segment 210-2 can have a higher probability than taxiway segments beyond the taxiway segment continuing down relative to start point 204, and the computing device can choose taxiway segment 210-2. The computing device may choose taxiway segments based on probability and/or other factors.

Likelihood cost can be determined with probability. The likelihood cost can be based on taxiway route length, taxiway route time, minimum fuel expended to travel the taxiway route, and/or other factors.

The computing device can repeat the process at each taxiway segment junction for each taxiway segment of a taxiway route. Additionally, this process can be repeated to create a group of taxiway routes.

Aircraft taxiway routing, according to the present disclosure, can allow for safe and efficient route planning for ATC controllers and pilots of aircraft at an airfield of an airport. Aircraft taxiway routing can incorporate past routes, past conditions, and ATC controller preferences to provide taxiway routes to pilots to guide their aircraft safely from a start point to an end point, which can reduce delays for passengers and/or airlines.

Figure 3:
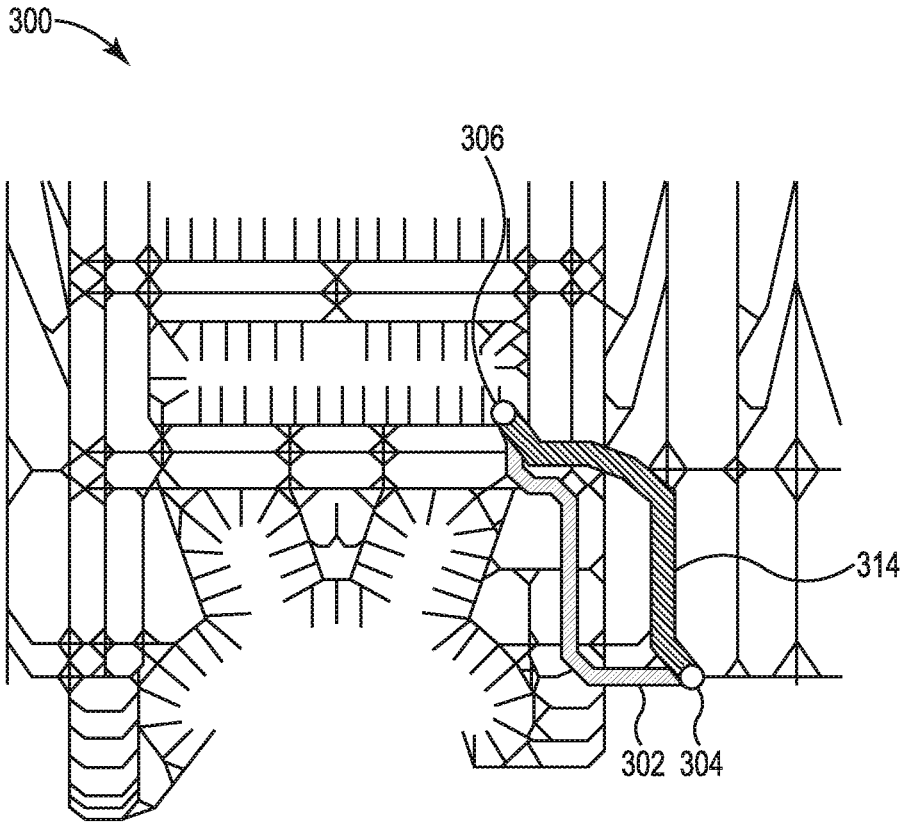
FIG. 3 is an illustration of a display provided on a user interface showing an airfield, generated in accordance with one or more embodiments of the present disclosure.

FIG. 3 is an illustration of a display provided on a user interface showing an airfield 300, generated in accordance with one or more embodiments of the present disclosure. As illustrated in FIG. 3, airfield 300 can include routing plan 302, start point 304, end point 306, and modified routing plan 314.

The computing device can receive a routing plan request. The routing plan request can be a request in response to an aircraft requesting to move from start point 304 to end point 306. For example, an aircraft may land at airfield 300, and request a taxiway route from the runway to a parking stand. The routing plan request can include start point 304 and end point 306.

The computing device can generate, in response to receiving the routing plan request, a routing plan for an aircraft at airfield 300 using the group of taxiway routes. The group of taxiway routes can be possible taxiway routes from start point 304 to end point 306, previously described with respect to FIG. 2.

The computing device can generate routing plan 302 for the aircraft using the most likely path between start point 304 and end point 306 on airfield 300. For example, based on the single vector representation of the taxiway segments of each respective taxiway route included in the group of taxiway routes, and the matrix representation of occupancy of the taxiway segments of each respective taxiway route included in the group of taxiway routes, the most likely route of the group of taxiway routes can be chosen to be the routing plan 302. The most likely route can be based on the probabilities of each taxiway segment of the sequence of taxiway segments included in each respective taxiway route of the group of taxiway routes.

As previously described in connection with FIG. 2, selecting a taxiway route from the group of taxiway routes that is the most likely path can be based on the probabilities for the taxiway segments at each taxiway junction of each respective taxiway route. Generating routing plan 302 can include selecting the taxiway route from the group of taxiway routes that is a shortest path based on the probabilities for the taxiway segments at each taxiway junction of each respective taxiway route. For example, the routing plan 302 can be the shortest path between start point 304 and end point 306 based on the global routing conditions and the occupancy of airfield 300.

As illustrated in FIG. 3, routing plan 302 can be displayed to a user via a user interface in a single integrated display. For example, routing plan 302 can be displayed to an ATC controller. The ATC controller can relay routing plan 302 to a pilot of an aircraft at start point 304 such that the pilot can navigate the aircraft from start point 304 to end point 306.

In some embodiments, routing plan 302 may be generated and displayed to an ATC controller, but the ATC controller may prefer to modify routing plan 302. For example, the ATC controller may prefer the aircraft travel a different taxiway route from start point 304 to end point 306 than is generated by routing plan 302. The ATC controller may modify the generated routing plan 302 via a user input to the user interface. For example, the ATC controller can select a portion of routing plan 302 and "drag and drop" the routing plan to a different taxiway segment to create a modified routing plan 314.

In response to the modification of the routing plan, the computing device can update the routing data with modified routing plan 314. For example, modified routing plan 314 can be included in routing data, and can be utilized as a historical routing plan for future use in generating a group of taxiway routes.

Figure 4:
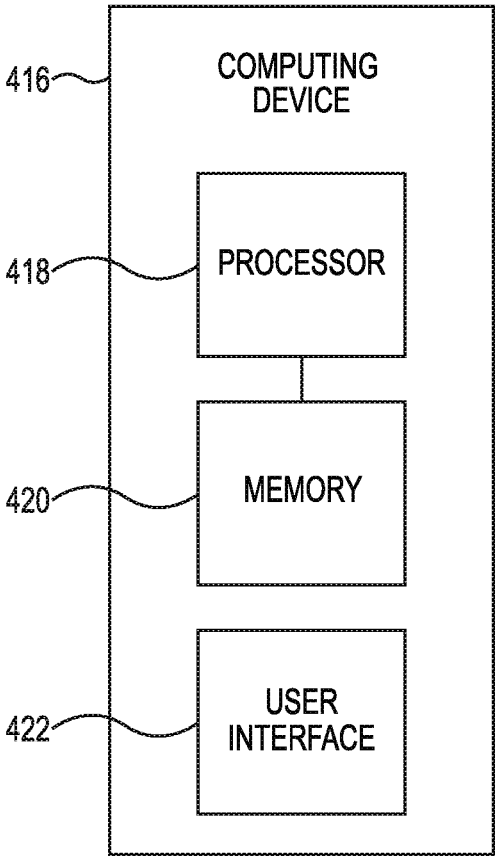
FIG. 4 is a computing device for aircraft taxiway routing, in accordance with one or more embodiments of the present disclosure.

FIG. 4 is a computing device 416 for aircraft taxiway routing, in accordance with one or more embodiments of the present disclosure. As illustrated in FIG. 4, computing device 416 can include a user interface 422, memory 420 and a processor 418 for aircraft taxiway routing in accordance with the present disclosure.

Computing device 416 can be, for example, a laptop computer, a desktop computer, and/or a mobile device (e.g., a smart phone, tablet, personal digital assistant, smart glasses, a wrist-worn device, etc.), and/or redundant combinations thereof, among other types of computing devices.

The memory 420 can be any type of storage medium that can be accessed by the processor 418 to perform various examples of the present disclosure. For example, the memory 420 can be a non-transitory computer readable medium having computer readable instructions (e.g., computer program instructions) stored thereon that are executable by the processor 418 for aircraft taxiway routing in accordance with the present disclosure. The computer readable instructions can be executable by the processor 418 to redundantly generate the aircraft taxiway routing.

The memory 420 can be volatile or nonvolatile memory. The memory 420 can also be removable (e.g., portable) memory, or non-removable (e.g., internal) memory. For example, the memory 420 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 420 is illustrated as being located within computing device 416, embodiments of the present disclosure are not so limited. For example, memory 420 can also be located internal to another computing resource (e.g., enabling computer readable instructions to be downloaded over the Internet or another wired or wireless connection).

As illustrated in FIG. 4, computing device 416 includes a user interface 422. For example, the user interface 422 can display aircraft taxiway routing (e.g., as previously described in connection with FIGS. 1-3) in a single integrated display, such as a routing plan, a taxiway route, a taxiway segment, and/or a taxiway segment junction, among other aircraft taxiway routing items as previously described in connection with FIGS. 1-3. A user (e.g., operator) of computing device 416 can interact with computing device 416 via user interface 422. For example, user interface 422 can provide (e.g., display and/or present) information to the user of computing device 416, and/or receive information from (e.g., input by) the user of computing device 416. For instance, in some embodiments, user interface 422 can be a graphical user interface (GUI) that can provide and/or receive information to and/or from the user of computing device 416. The display can be, for instance, a touch-screen (e.g., the GUI can include touch-screen capabilities). Alternatively, a display can include a television, computer monitor, mobile device screen, other type of display device, or any combination thereof, connected to computing device 416 and configured to receive a video signal output from the computing device 416.

As an additional example, user interface 422 can include a keyboard and/or mouse the user can use to input information into computing device 416. Embodiments of the present disclosure, however, are not limited to a particular type(s) of user interface.

User interface 422 can be localized to any language. For example, user interface 422 can display the airfield workflow management in any language, such as English, Spanish, German, French, Mandarin, Arabic, Japanese, Hindi, etc.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A computing device for aircraft taxiway routing, comprising:

a memory;

a processor configured to execute executable instructions stored in the memory to:

receive routing data associated with an airfield of an airport, wherein the routing data includes an occupancy of a number of taxiway segments and positions of vehicles and different aircraft on the airfield of the airport;

determine a group of taxiway routes associated with the airfield of the airport using the routing data using a single vector representation of the taxiway segments of each respective taxiway route included in the group of taxiway routes by classifying, via support vector machine classification, the single vector representation of each of the taxiway segments of each respective taxiway route as binary vectors at each taxiway segment junction of each taxiway route, wherein each respective taxiway route of the group of taxiway routes includes the number of taxiway segments;

receive a routing plan request;

generate a most likely path of the group of taxiway routes using the classification of the single vector representation of each of the taxiway segments of each respective taxiway route;

generate, in response to receiving the routing plan request, a routing plan for an aircraft at the airfield using the most likely path of the group of taxiway routes; and a user interface configured to display the routing plan in a single integrated display.

2. The computing device of claim 1, wherein the processor is configured to execute the instructions to determine the group of taxiway routes using a matrix representation of occupancy of the taxiway segments of each respective taxiway route included in the group of taxiway routes and discretized time intervals.

3. The computing device of claim 2, wherein a taxiway segment of a taxiway route included in the group of taxiway routes is represented as occupied in the matrix representation of occupancy in response to a different aircraft being present on the taxiway segment.

4. The computing device of claim 1, wherein the processor is configured to execute the instructions to determine the group of taxiway routes for a start point on the airfield of the airport and an end point on the airfield of the airport.

5. The computing device of claim 1, wherein the routing data includes historical routing plans for aircraft at the airfield.

6. The computing device of claim 1, wherein the routing data further includes global routing conditions of the airfield.

7. The computing device of claim 6, wherein the global routing conditions include at least one of:

weather conditions at the airport;

time of day;

aircraft movement type; and aircraft class.

8. The computing device of claim 1, wherein the processor is configured to execute the instructions to:

receive an input to modify the generated routing plan; and display the modified routing plan in the single integrated display.

9. The computing device of claim 8, wherein the processor is configured to execute the instructions to update the routing data with the modified routing plan.

10. A non-transitory computer readable medium having computer readable instructions stored thereon that are executable by a processor to:

receive routing data associated with an airfield of an airport, wherein the routing data includes an occupancy of a number of taxiway segments and positions of vehicles and different aircraft on the airfield of the airport;

determine a group of taxiway routes associated with the airfield of the airport using the routing data, wherein each respective taxiway route of the group of taxiway routes includes the number of taxiway segments, and wherein the group of taxiway routes is determined by:

representing each taxiway segment of a sequence of taxiway segments included in each respective taxiway route of the group of taxiway routes as a single vector representation by classifying, via deep-learning networks, the single vector representation of each of the taxiway segments of each respective taxiway route as binary vectors at each taxiway segment junction of each taxiway route; and representing occupancy of the sequence of taxiway segments included in each respective taxiway route of the group of taxiway routes using a matrix;

generate a most likely path using the classification of the single vector representation of each of the taxiway segments of each respective taxiway route;

generate a routing plan for an aircraft at the airfield using the most likely path of the group of taxiway routes; and display the routing plan for the aircraft in a single integrated display.

11. The computer readable medium of claim 10, wherein the computer readable instructions are executable by the processor to determine the group of taxiway routes using the matrix by classification of the single vector representation at each taxiway segment junction of the taxiway segments between a start point and an end point of each taxiway route.

12. The computer readable medium of claim 11, wherein the computer readable instructions are executable by the processor to determine the the group of taxiway routes by generating the most likely path for the start point to the end point using the classification of the single vector representation at each taxiway segment junction of the taxiway segments of each taxiway route.

13. The computer readable medium of claim 10, wherein the computer readable instructions are executable by the processor to generate the routing plan for the aircraft by determining a probability for each taxiway segment of the sequence of taxiway segments included in each respective taxiway route of the group of taxiway routes.

14. A method for aircraft taxiway routing, comprising:

receiving, by a computing device, routing data associated with an airfield of an airport, wherein the routing data includes an occupancy of a number of taxiway segments and positions of vehicles and different aircraft on the airfield of the airport;

determining, by the computing device, a group of taxiway routes associated with the airfield of the airport using the routing data, wherein each respective taxiway route of the group of taxiway routes includes the number of taxiway segments, and wherein the group of taxiway routes is determined by:

representing each taxiway segment of a sequence of taxiway segments included in each respective taxiway route of the group of taxiway routes as a single vector representation by classifying, via at least one of deep-learning networks and support vector machine classification, the single vector representation of each of the taxiway segments of each respective taxiway route as binary vectors at each taxiway segment junction of each taxiway route; and representing occupancy of the sequence of taxiway segments included in each respective taxiway route of the group of taxiway routes using a matrix; and determining a probability for each taxiway segment of the sequence of taxiway segments of each respective taxiway route of the group of taxiway routes;

generating, by the computing device, a most likely path using the classification of the single vector representation of each of the taxiway segments of each respective taxiway route based on the probability for each taxiway segment;

generating, by the computing device, a routing plan for an aircraft at the airfield using the most likely path of the group of taxiway routes; and displaying, on a user interface of the computing device, the routing plan in a single integrated display.

15. The method of claim 14, wherein the method includes determining each respective taxiway route of the group of taxiway routes by selecting a taxiway segment at a taxiway segment junction having a higher probability than other taxiway segments at the taxiway segment junction for each taxiway segment junction of that taxiway route.

16. The method of claim 15, wherein the method includes selecting a taxiway segment at the taxiway segment junction having a lower likelihood cost than the other taxiway segments at the taxiway segment junction in response to the probability for each taxiway segment at the taxiway segment junction being equal for each respective taxiway route.

17. The method of claim 14, wherein the method includes generating the most likely path based on the probabilities for the taxiway segments at each taxiway junction of each respective taxiway route.

18. The method of claim 14, wherein generating the routing plan for the aircraft includes selecting a taxiway route from the group of taxiway routes that is a shortest path based on the probabilities for the taxiway segments at each taxiway junction of each respective taxiway route.

* * * * *